United States Patent [19]

Kubiak et al.

[11] Patent Number: 4,841,852

[45] Date of Patent: Jun. 27, 1989

[54] MOBILE TRUSS-MAKING APPARATUS

[76] Inventors: Jim Kubiak, 855 S. Waterview, Clermont, Fla. 32711; S. R. Bliven, 4513 S. Trask St., Tampa, Fla. 33611

[21] Appl. No.: 169,370

[22] Filed: Mar. 17, 1988

[51] Int. Cl.[4] ..... B30B 15/00; B25C 7/00

[52] U.S. Cl. ..... 100/100; 100/913; 104/89; 227/151; 269/17; 269/45; 269/910

[58] Field of Search ..... 100/100, 913; 227/151, 227/152, 154; 269/910, 17, 37, 291, 45; 104/91, 93, 95, 89; 280/656; 212/187; 29/798; 403/400; 198/678

[56] References Cited

U.S. PATENT DOCUMENTS

| | | | |
|---|---|---|---|
| 2,662,565 | 12/1953 | LeVay | 269/910 X |
| 3,068,484 | 12/1962 | Moehlenpah et al. | 100/913 X |
| 3,367,010 | 2/1968 | Lytle et al. | 227/152 X |
| 3,379,354 | 4/1968 | Moehlenpah et al. | 269/910 X |
| 3,711,007 | 1/1973 | Fry | 227/152 X |
| 3,752,467 | 8/1973 | Stanley | 269/17 X |
| 4,084,499 | 4/1978 | Moehlenpah | 100/913 X |
| 4,111,114 | 9/1978 | Carr | 100/100 |
| 4,174,061 | 11/1979 | McDonald | 100/913 X |
| 4,453,705 | 6/1984 | McDonald | 100/913 X |
| 4,567,821 | 2/1986 | McDonald | 100/100 |

*Primary Examiner*—Harvey C. Hornsby
*Assistant Examiner*—Scott J. Haugland
*Attorney, Agent, or Firm*—Ronald E. Smith; Joseph C. Mason, Jr.

[57] ABSTRACT

A mobile apparatus having utility in the construction of roof trusses at a job site. An elongate trailer frame is mounted to a wheel and axle assembly and is transportable on public highways by towing. A jig assembly supported by the frame is formed primary of uni-strut members and has a first elongate fixed position side rail and a second parallel but movable jig support rail. Plural transversely disposed jig members are slidably mounted for lateral movement along the extent of the first and second side rails of the jig assembly. A clinching device is mounted for longitudinal movement along the extent of the jig assembly by an overhead cantilevered track support structure. The jig assembly is longitudinally extendable, and the overhead track support member has a hingedly mounted auxiliary portion that may be deployed so that the clincher device can reach even the extended portion of the jig assembly.

20 Claims, 4 Drawing Sheets

10
12
14
15
16
17
18a
18b
19
20
22
24
24a
25
26
28
28a
28b
29
29a
29b
30
30a
32

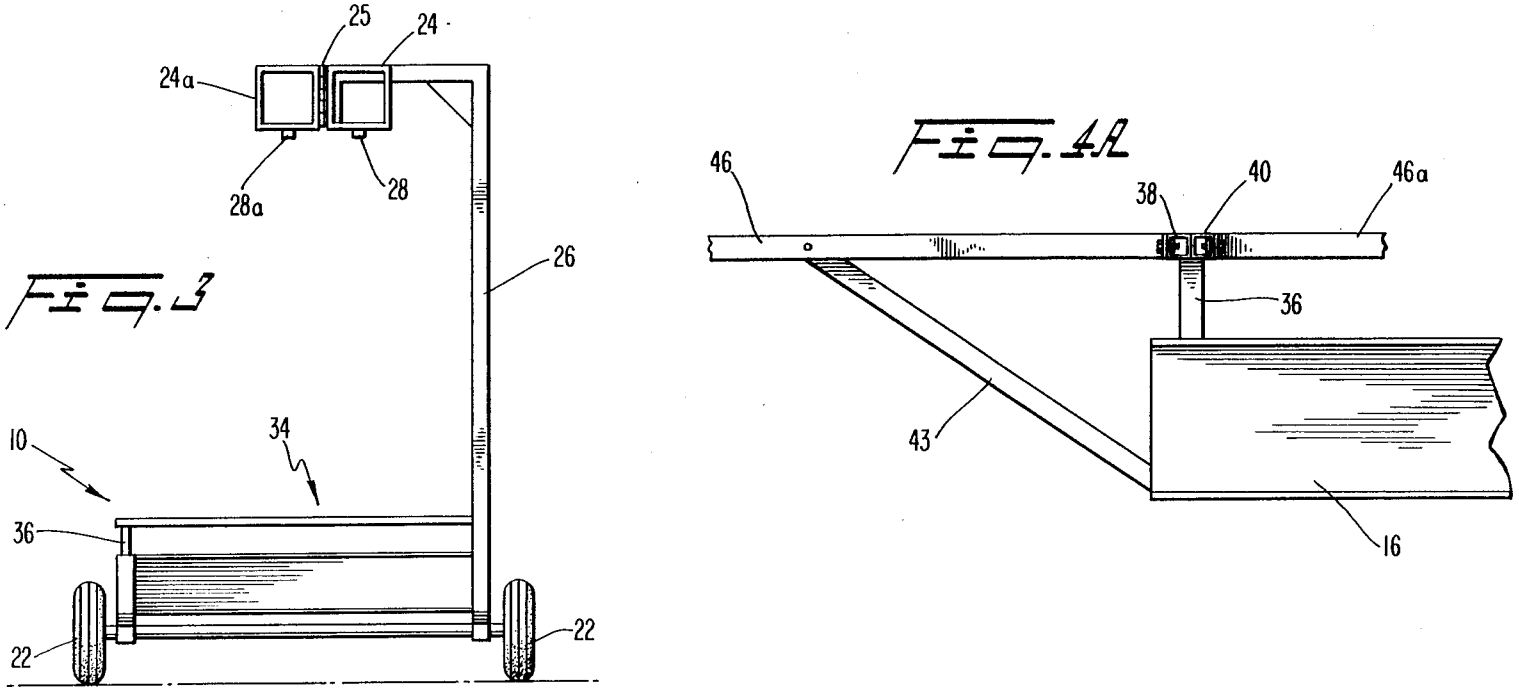
FIG. 2
FIG. 3
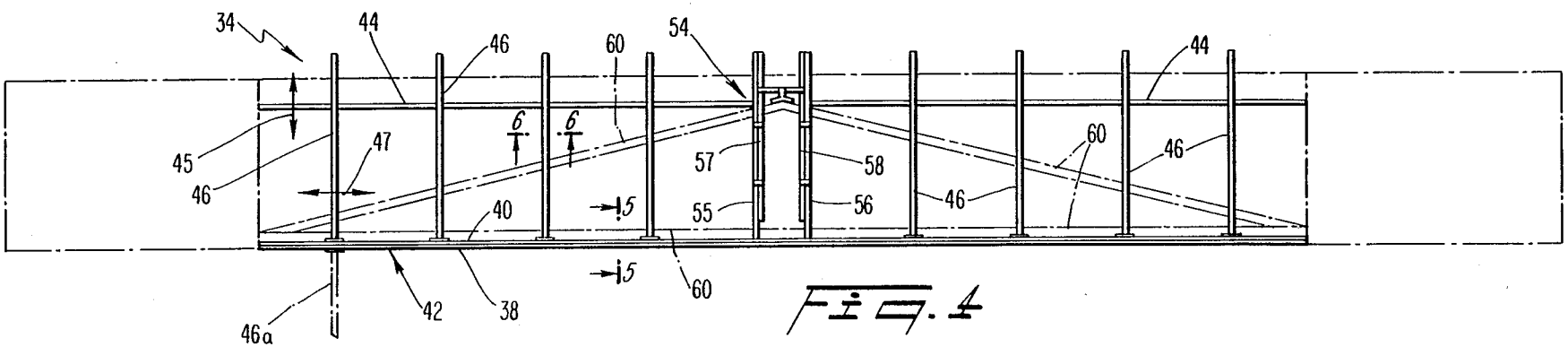
FIG. 4

MOBILE TRUSS-MAKING APPARATUS

BACKGROUND OF THE INVENTION

1. Field of the Invention.

This invention relates, generally, to devices that facilitate the construction of roof trusses, and more specifically relates to such a device that is highway transportable and adjustable in length.

2. Description of the Prior Art.

Devices that make roof trusses fall within two major classifications: fixed position or immobile, and mobile. The former are used in truss making plants that ship the finished product to the job site, whereas the latter allows truss assembly at the site.

The advantages of the latter type of equipment include the ability of the construction foreman at the job site to control the quality of the final product.

A typical fixed position truss-making apparatus is shown in U.S. Pat. No. 3,367,010 to Lytle, et. al.

A typical mobile device is shown in U.S. Pat. No. 4,567,821 to McDonald.

Additional examples of both mobile and immobile truss-making apparatuses are shown in the following U.S. Pat. Nos.: 4,304,046 to McDonald (1981); 3,752,467 to Stanley (1973); 4,453,705 to McDonald (1984); 3,379,354 to Moehlenpah, et. al. (1968); 3,068,484 to Moehlenpah, et. al. (1962); 4,174,061 to McDonald (1979); 4,084,499 to Moehlenpah (1978); and 3,711,007 to Fry (1973).

Although the art is reasonably well developed, the devices of the prior art, although they adequately perform their intended functions, have certain limitations.

In a broad sense, the known immobile devices cannot be transported on public highways, and the known mobile devices lack versatility.

Accordingly, a mobile apparatus having a high degree of versatility is needed. Specifically, there is a need for a mobile device that can be easily extensible as needed to facilitate the construction of very large roof trusses at a job site. The needed device, preferably, would be constructed of stock materials and would therefore be inexpensive to manufacture.

However, the art neither teaches nor suggests how a mobile device having the qualities missing from the structures of the prior art could be constructed.

SUMMARY OF THE INVENTION

The long-standing but heretofore unfulfilled need for a mobile roof truss-forming apparatus having capabilities beyond the capabilities of the mobile and immobile devices of the prior art is now provided in the form of an apparatus that is transportable upon public highways on a mobile home-type frame and which is easily extended to handle very large trusses.

The invention includes a rigid trailer frame and a jig assembly supported thereby; the jig assembly has plural moving parts.

The trailer frame is rectangular in plan view and includes a pair of parallel, longitudinally extending side rail members that are interconnected at equidistantly spaced intervals by a plurality of transversely spaced channel and box tube members.

A jig means having elongate, longitudinally disposed side rail members and transversely disposed jig members extending therebetween is supported by the trailer frame and is spaced therefrom by plural post members that extend the length of the trailer frame.

One of the side rail members of the jig means is movable in a horizontal plane in a forward and backward direction; the jig members are movable in a horizontal plane in a left and right direction.

The jig means may be augmented or extended longitudinally at the job site by bolting on an auxiliary jig structure at each or either end of the main jig assembly.

An overhead track support member and track means supported thereby extends the entire length of the trailer frame. Auxiliary track support members are hingedly mounted to the main track support member and align with the primary support member when swung through a 180 degree arc. When so deployed, the auxiliary track support member and auxiliary track means extends the length of the augmented jig assembly.

A hydraulic clincher means is suitably counter balanced and is movably mounted along the extent of said main track means and the auxiliary means so that when the auxiliary track support members are swung out into their respective deployed positions, the clincher means may extend to any point above the auxiliary jig assembly members.

Accordingly, the novel apparatus has no significant limitations and facilitates the making of roof trusses of any size and shape at a job site.

It is therefore seen to be a primary object of this invention to provide a roof truss-making apparatus that, although small enough to be transportable over public roads, may be extended at the job site, if needed.

The invention accordingly comprises the features of construction, combination of elements and arrangement of parts that will be exemplified in the descriptions set forth hereinafter and the scope of the invention will be set forth in the claims.

BRIEF DESCRIPTION OF THE DRAWINGS

FIG. 3 is an end view of the inventive apparatus;

FIG. 4 is a plan view of the jig assembly supported by the trailer frame;

Similarly reference numerals refer to similar parts throughout the several views of the drawings.

DETAILED DESCRIPTION OF THE PREFERRED EMBODIMENT

Figures 1, 1A, 1B, 1C:
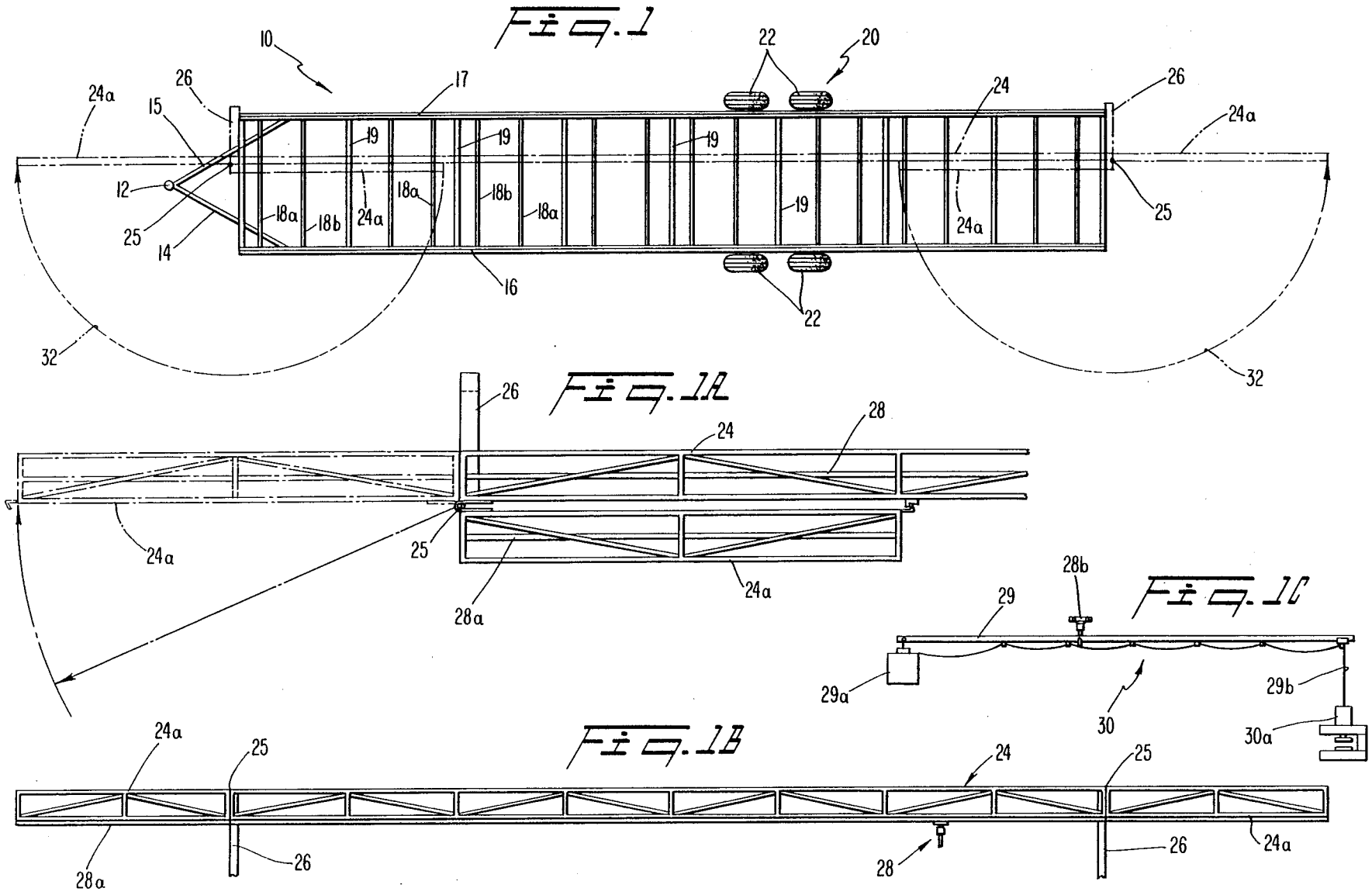
FIG. 1 is a top plan view of the trailer frame portion of the invention.
FIG. 1A is a top plan view showing the hinged interconnection between the main track support member and the auxiliary track support member.
FIG. 1B is a side elevational view of the novel track support means in its deployed configuration.
FIG. 1C is a side elevational view of the clincher assembly.
Figure 5:
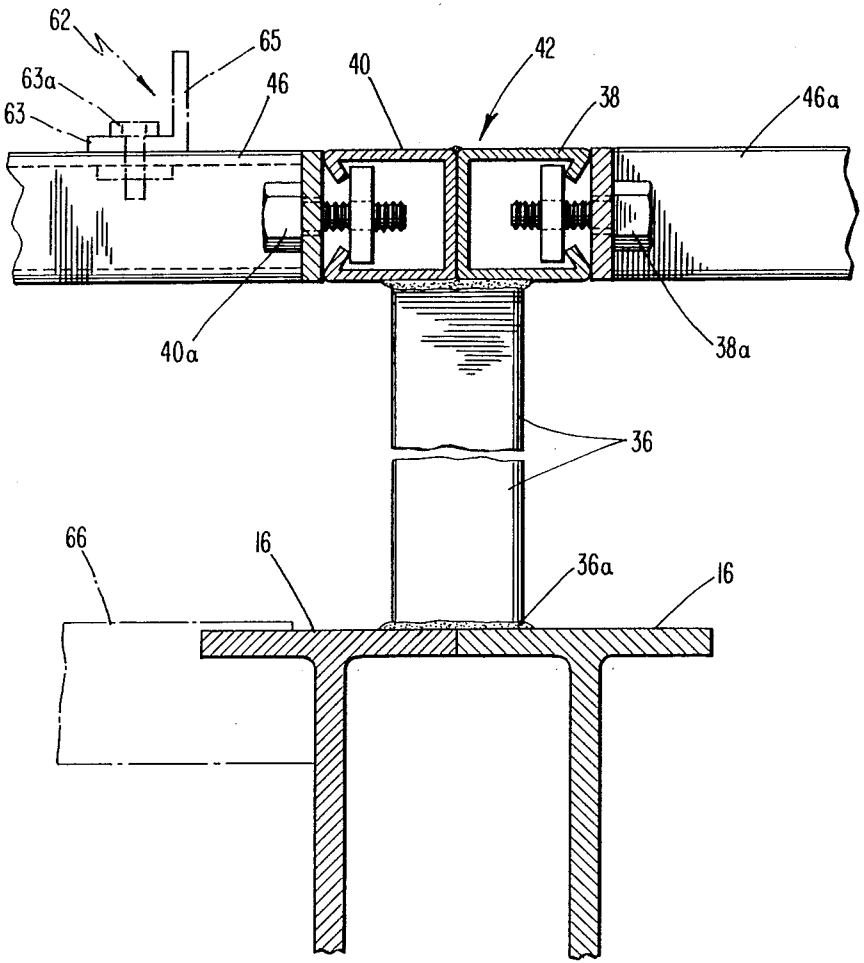
FIG. 5 is an end view taken substantially along line 5—5 in FIG. 2.

Referring now to FIG. 1, it will there be seen that the trailer frame portion of the novel apparatus is denoted by the reference 10 as a whole. Trailer frame 10 includes a ball member at its forwardmost end to facilitate its towing by a suitable truck in a conventional manner. A pair of angularly disposed I-beam members denoted 14, 15 extend between and interconnect ball member 12 to a pair of elongate, parallel I-beam or side rail members 16, 17, respectively. I-beams 16, 17, as shown in FIG. 5, are double I-beam constructions.

Side rail members 16, 17 are interconnected by a plurality of equidistantly spaced, transversely disposed box tube, uni-strut, and channel members, collectively designated 18*a*, 18*b* and 19, respectively. The common length of said box tube, uni-strut, and channel members determines the width of frame 10; the length is selected to allow public highway transport of frame 10.

Figure 2:
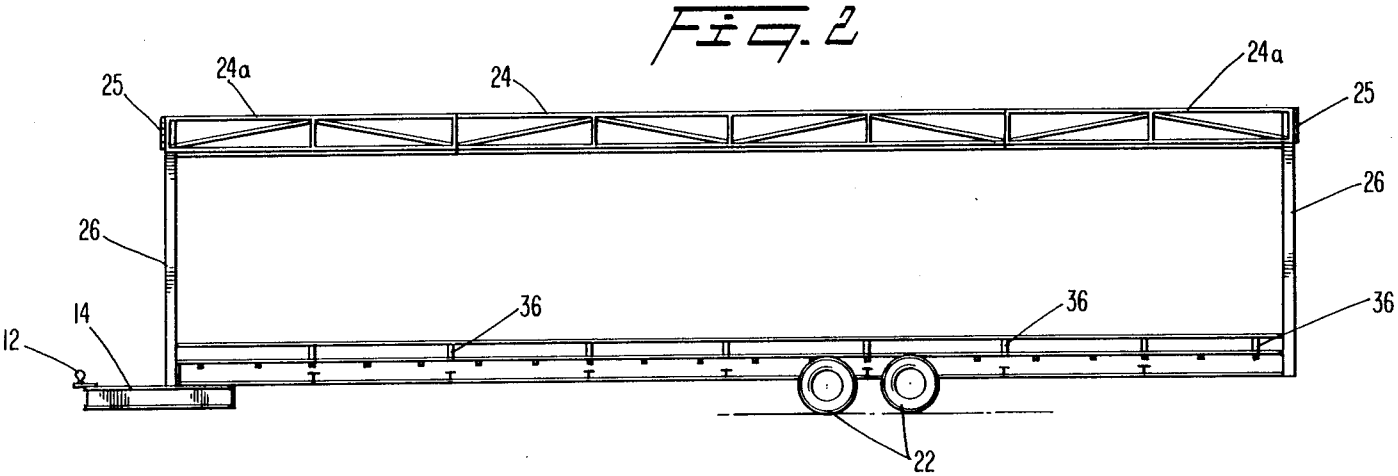
FIG. 2 is a front elevational view of the trailer frame shown in FIG. 1.

A pair of axle assemblies, of the mobile home type, are collectively denoted 20 and include plural, rotatably mounted wheel members 22; said axle assemblies serve to position frame 10 at a preselected height above a roadway or other support surface as best shown in FIG. 2.

Track support member 24 is also clearly shown in FIG. 2; it extends the entire extent of frame 10 and is supported at its longitudinally spaced opposite ends by column support members 26.

As shown in FIGS. 1B, 1C and 3, track support member 24 supports track means 28; the clincher means, denoted 30 as a whole and shown in FIG. 1C, includes track means engagement member 28*b*, a boom member 29, a hydraulic electric pump 29*a*, and a hydraulic clincher member 30*a* connected to pump 29*a* by line 29*b*, which clincher means travels along track support member 24 and thus may be positioned at any point above frame 10.

The overhead track assembly 24 is mounted above frame 10 in cantilever fashion as shown in FIG. 3.

All of the parts referred to hereinabove are fixed position, i.e., frame 10 per se, is not adjustable. A pair of auxiliary track support members 24*a* are hingedly mounted as at 25 to opposite ends of the primary track support member 24; each auxiliary member 24*a* includes an auxiliary track means 28*a* (FIG. 3); accordingly, each auxiliary apparatus may be swung through a 180 degree arc 32 as shown in FIG. 1. When fully deployed, as shown in FIG. 1B, the auxiliary track support member 24*a* and track means 28*a* will align with the primary track support means 24 and primary track means 28 so that clincher means 30, shown in FIG. 1C, may run the entire extent of the extended jig assembly, which jig assembly is described hereinafter.

When not needed, the auxiliary assembly 24*a* is folded to its closed position forwardly (or rearwardly, if desired) of the primary track support assembly, as perhaps best shown in FIG. 1A.

FIG. 3 shows that jig assembly 34 is disposed in a horizontal plane above the plane of frame 10. The vertical spacing between jig assembly 34 and frame 10 is determined by the height of post members 36, only one of which appears in FIG. 3.

Figure 6:
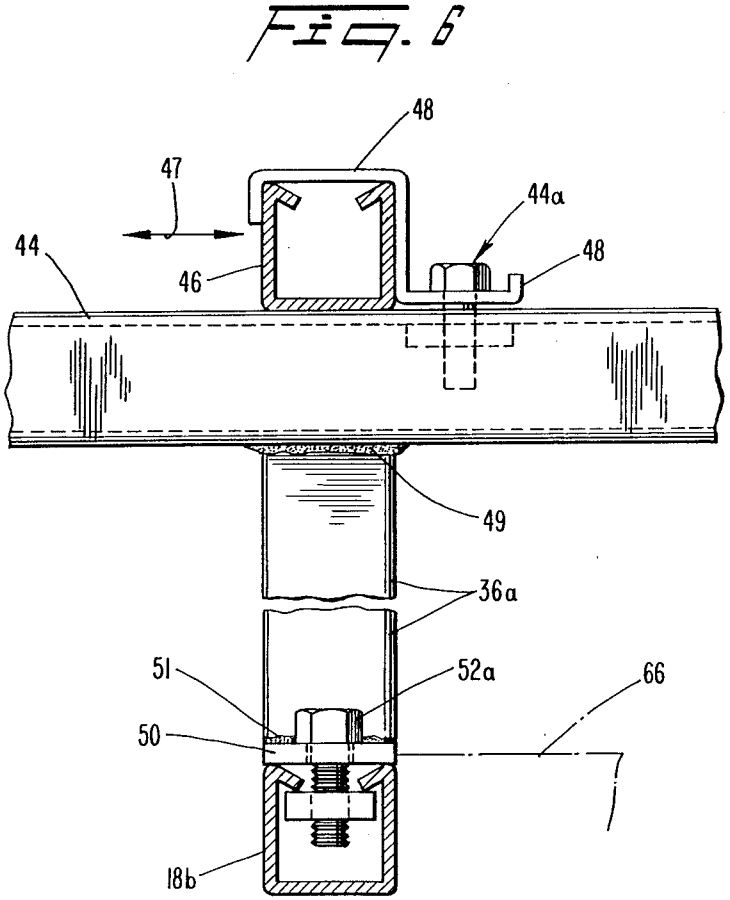
FIG. 6 is a view taken substantially along line 6—6 in FIG. 4.

Reference should now be made to FIGS. 4–6.

Jig assembly 34 is shown in plan view in FIG. 4; it includes a pair of elongate, abutting uni-strut members 38, 40 that collectively define a fixed position jig side rail member 42. A plurality of equidistantly spaced, upstanding post members 36 are fixedly secured at their respective lower ends 36*a* (FIG. 5) to frame side rail members 16, as perhaps best understood by comparing FIG. 2 with FIG. 5; in this manner, jig side rail 42 (consisting of elongate uni-strut members 38, 40) is held in a fixed position and is suitably spaced (preferably about 7") above the plane of frame member 10.

Jig support member 44, shown in FIGS. 4 and 6, is movably mounted; specifically, it is mounted for forward and rearward movement in a horizontal plane as indicated by double-headed directional arrow 45 in FIG. 4. Jig support member 44 is a single, elongate, upwardly opening uni-strut member as perhaps best shown in FIG. 6.

As shown in FIG. 4, a first plurality of horizontally disposed transversely and movably mounted jig members 46, which members are uni-strut members as best shown in FIG. 6, are movably mounted for left and right (i.e. lateral) movement in a horizontal plane as indicated by double headed directional arrow 47 in FIGS. 4 and 6; an identically mounted, second plurality of said jig members, only one of which, 46*a*, is shown in phantom lines in FIG. 4, extends in an opposite or outward direction relative to fixed position side rail member 38 to allow the making of very large roof truss assemblies. As shown in FIG. 2C, a brace member 43 extends between frame I-beam member 16 and auxiliary jig member 46*a*. Laterally adjustable jig members 46, 46*a*, are also shown in FIG. 5.

Figure 2B:
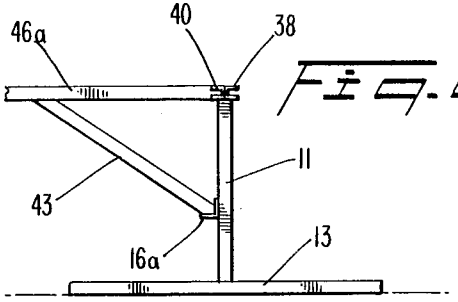
FIG. 2B is an opposite end view of the jig extension member shown in FIG. 2A.
Figure 2A:
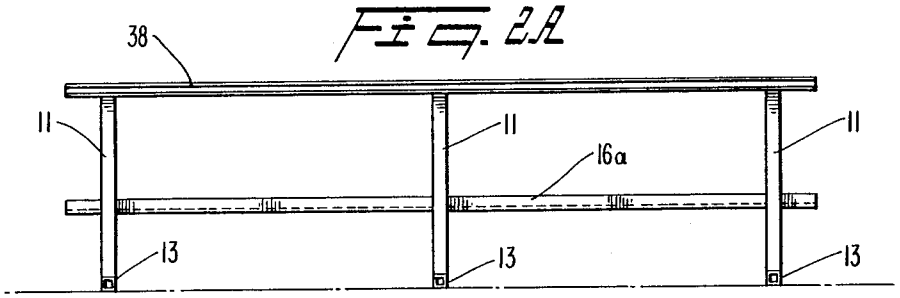
FIG. 2A is a side elevational view of a free-standing jig assembly extension member.
Figure 2C:
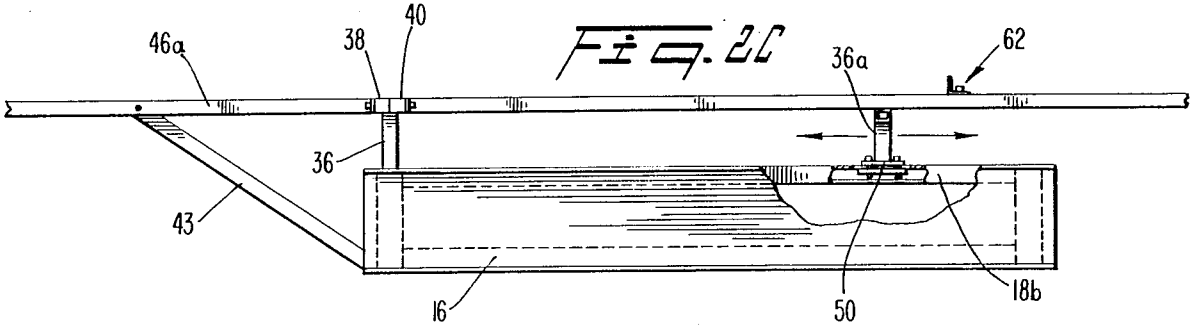
FIG. 2C is an end view of an alternate extension member.

FIGS. 2A and 2B depict free standing jig assembly extension members. Elongate bracket 16*a* is positioned in longitudinal alignment with I-beam member 16, at either or both ends of a jig assembly as required by the particular job undertaken; brace 43 supports auxiliary jig member 46*a* as shown. Instead of being secured to I-beam member 16 as in the embodiment of FIG. 2C, longitudinally support members 11 that are fixedly secured to foot members 13.

As shown in FIG. 5, uni-strut members 38, 40 are channel-defining members that slidably receive associated screw members 38*a*, 40*a*, respectively. Accordingly, jig member 46 (and 46*a*, if needed) are slidable along the extent of said uni-strut members 40, 38, respectively.

In a similar manner, the opposite ends of said jig members 46 are slidably mounted relative to the adjustable jig support member 44, as perhaps best shown in FIG. 6. Jig support member 44 is a uni-strut member having an upwardly opening channel into which screw members 44*a*, only one of which is shown, extend; said screw members 44*a* are connected by S-clamp members 48 to jig members 46, and, when loosened, permit slidable adjustment of said jig members 46, along the longitudinal extent of jig support member 44 as indicated by double headed reference arrow 47 in FIG. 6.

As shown in FIG. 6, the bottom surface of jig support member 44 is welded as at 49 at equidistantly spaced intervals along its extent to plural post members 36*a* which are in turn welded at their respective bases as at 51 to base plate members 50. The height of movable post members 36*a* is less than that of immobile post members 36.

Each plate member 50 surmounts an open-topped fixed position uni-strut member 18*b* which forms a part of immobile trailer frame 10 as shown in FIG. 1 and as aforesaid; bolt member 52*a* is slidably mounted into the channel and accordingly, when loosened, allows plate 50 and hence post 36*a* and hence jig support member 44 to travel as indicated by double headed directional arrow 45 in FIG. 4, i.e., into and out of the paper as shown in FIG. 6.

Still further uni-strut members are used to form the peak locator means 54 of this novel apparatus, as shown in FIG. 4. A first pair of uni-strut members 55, 56 are slidably mounted for movement along the extent of elongate longitudinally disposed uni-strut member 40 as shown, in the same manner as jig members 46 (FIG. 5).

A second pair of uni-strut members 57, 58 is suitably joined to the facing sides of said first pair 55, 56 as shown in FIG. 4. In this manner, peak locator member 54 is slidable along the extent of inner members 57, 58, thereby providing a means whereby roof trusses of varying pitches can be constructed.

It is clear that the use of uni-strut members throughout jig assembly 34 allows the above-described lateral adjustment of jig members 46, 46*a*, 55, 56 (of the peak locator), the forward and rearward movement of jig support member 44, and the forward and rearward movement of peak locator member 54.

However, still further advantages reside in the use of the uni-strut members. Whereas the art teaches the use of cam members, levers, and other mechanisms to hold in place the lumber used in making the truss during the clinching procedure, the unique use of the uni-strut members as disclosed herein obviates the need for such devices.

It should be understood that the invention is used by placing the various pieces of lumber to be used to form a roof truss atop jig assembly 34 (FIG. 4). The outer boundary of a typical roof truss is shown in FIG. 4 in phantom lines and is denoted 60. Additional lumber is properly positioned within said outer frame 60. Metal plates, often called truss plates, clincher plates, or gusset plates, are positioned in overlying relation to each lumber joint. The clincher means of FIG. 1C is then employed in the known manner to press the teeth or spikes of the respective truss plates into their associated pieces of lumber to thereby form the desired secure joint.

Thus, it is important to hold the various pieces of lumber in their proper positions relative to all other pieces of lumber deployed atop jig 34.

In lieu of the expensive holding devices of the prior art, the present inventive mobile truss apparatus employs simply constructed, commercially available angle brackets or adjustment clips 62, one of which is shown in phantom lines in FIG. 5, to perform the lumber-holding function.

The horizontal portion 63 of each clip 62 is slidably mounted on its associated jig member 46 or 46*a* and is positionable and fixedly securable at any preselected position along the extent thereof by tightening a screw member 63*a*. The integral vertical portion 65 thereof thus abuts a piece of lumber and serves to hold it in place during the attachment of the truss plate by the clincher means 30.

More specifically, each clip 62 forms one-half of a pair of clips during the clinching procedure; the second clip is cooperatively aligned on the same jig member 46 or 46*a*, but reversely oriented so that the respective vertical portions 65 of the clips provide a sandwiching hold on the lumber therebetween, i.e., opposed clips 62 cooperate to compress together the distinct pieces of lumber so that their joints will be secure. It is the duty of the jig operator to firmly place each clip in tight abutting relation to its associated piece of lumber to insure that each clip 62 has its opposing counterpart so that the desired compressive forces are generated.

Clearly, once the clincher plates have been squeezed into position by clinching means 30 and the joints have been secured, it is a simple and non-time consuming procedure to loosen each clip and slide it away from the truss which has been completed so that said truss may be removed from the jig assembly 34 and installed on the structure under construction.

Still another feature of the invention is shown in FIGS. 5 and 6; and expanded metal lath 66 is welded to the top surface of interior I-beam members 16 of frame 10. The lath 66 is discontinuous at each post 36*a* as indicated in FIG. 6 to permit travel of jig support member 44. Accordingly, lath 66 provides a convenient support surface for walking upon and for supporting boards not yet placed on jig assembly 34.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus having utility in the construction of roof trusses comprising:
   - a frame member;
   - wheel and axle means operatively connected to said frame member so that said frame member is transportable over public highways;
   - a jig assembly supported by said frame member;
   - a primary track support member including a primary track means supported thereby;
   - said primary track support member and primary track means positioned above said jig assembly and being co-extensive therewith;
   - an auxiliary jig assembly means connectable to said jig assembly to increase its extent;
   - an auxiliary track support member including an auxiliary track means supported thereby;
   - said auxiliary track support member being hingedly connected to said primary track support member and having a first, closed position and a second, extended position where said primary track means and said auxiliary track means are co-extensive with said jig assembly and said auxiliary jig assembly, respectively.

2. The apparatus of claim 1, wherein said auxiliary jig assembly includes first and second auxiliary jig assembly members, and wherein said jig assembly is extendable by connecting at least one of said auxiliary jig assembly members to said jig assembly.

3. The apparatus of claim 2, further comprising:
   - a clincher means;
   - said clincher means including an elongate boom member;
   - said clincher means including a clincher member supported by said boom member;
   - said boom member being slidably mounted with respect to said primary and auxiliary track means so that said clincher member is positionable at any preselected position along the extent of said augmented jig assembly.

4. The apparatus of claim 3, wherein said jig assembly is generally rectangular in configuration, includes first and second elongate, longitudinally disposed jig assembly side rail members, wherein said first side rail member is fixedly secured to said frame member in vertically spaced relation thereto and wherein said second side rail member is movably mounted for forward and backward movement in a horizontal plane.

5. The apparatus of claim 4, further comprising a first plurality of laterally spaced, transversely disposed jig members, each of which has a first end slidably mounted to said first side rail member and a second end slidably mounted to said second side rail member so that each of said first plurality of jig members is movable in a lateral direction along the extent of said jig assembly, independently of each remaining first plurality of jig members.

6. The apparatus of claim 5, further comprising a second plurality of laterally spaced, transversely disposed jig members, each of which has a first end slidably mounted to said first side rail member and a second end projecting in a direction opposite to that of said first plurality of jig members.

7. The apparatus of claim 6, further comprising a plurality of jig member brace members extending between said frame member and respective free ends of said second plurality of jig members.

8. The apparatus of claim 7, wherein said first side rail member includes a pair of first and second channel members and wherein said first plurality of jig members is slidably mounted to said first channel member and said second plurality of jig members is slidably mounted to said second channel member.

9. The apparatus of claim 8, wherein said first and second channel members are elongate uni-strut members that are fixedly secured to one another in back-to-back relation so that respective channels defined by said channel members open forwardly and rearwardly, respectively.

10. The apparatus of claim 9, wherein said second side rail member is an elongate uni-strut member having an upwardly opening channel means for sliding reception of said first plurality of jig members.

11. The apparatus of claim 10, wherein said frame member is generally rectangular in configuration and includes a forward side rail member to which said jig assembly first side rail member is fixedly secured and a rearward side rail member that is interconnected to said jig assembly second side rail member by a plurality of transversely disposed, longitudinally spaced, frame uni-strut members.

12. The apparatus of claim 11, wherein said jig assembly second side rail member is fixedly mounted along its extent atop a plurality of spaced support post members, each of said support post members being slidably mounted for forward and rearward movement along the extent of said frame uni-strut members.

13. The apparatus of claim 12, wherein each of said first and second plurality of jig members is a uni-strut member defining an upwardly opening channel means.

14. The apparatus of claim 13, further comprising a means for pressing together lumber members employed to form a roof truss to facilitate the making of secure joints therebetween.

15. The apparatus of claim 14, wherein said means for pressing said lumber members together includes adjustment clip members having an "L"-shape, said adjustment clip members being movably mounted along the extent of each of said first and second plurality of jig members and being fixedly positionable at any preselected position along said extent.

16. The apparatus of claim 15, further comprising a peak locator means, said peak locator means including a peak locator member disposed in interconnecting relation between a pair of cooperatively positioned uni-strut members, opposite ends of said peak locator member being slidably mounted in opposing members of said pair of cooperatively positioned uni-strut members for forward and rearward movement in a horizontal plane, each member of said pair of cooperatively positioned uni-strut being fixedly secured to an associated jig member of said first plurality of jig members so that said peak locator means is positionable at any preselected position along the extent of said augmented jig assembly.

17. The apparatus of claim 16, wherein said frame member is substantially covered by a layer of sheet material so that said frame member can be walked upon and used as a support means for lumber to be placed atop said jig assembly.

18. The apparatus of claim 17, further comprising a clamp means for joining each jig member of said first plurality of jig members to said jig assembly second side rail member.

19. A mobile truss-making apparatus including a wheeled frame member that is transportable over public highways, a jig assembly supported by said frame member, said jig assembly being formed of channel-defining members, said jig assembly having a first and second plurality of oppositely extending jig members, said jig assembly including at least one auxiliary jig assembly member connectable to said jig assembly to increase its extend, said apparatus further including a primary track support member and primary track means integral with and positioned above said jig assembly, and an auxiliary track support member and an auxiliary track means integral therewith;

said auxiliary track support member being hingedly mounted to said primary track support member at one end thereof;

a collective track means of linear configuration being formed when said auxiliary track support member is swung into alignment with said primary track support member; and a clincher means being movably mounted along the entire extent of a collective track means.

20. A mobile truss-making apparatus including a wheeled frame member that is transportable over public highways, a jig assembly supported by said frame member, said jig assembly being formed of channel-defining members, said jig assembly having a first and second plurality of oppositely extending jig members, said jig assembly including at least one auxiliary jig assembly member connectable to said jig assembly to increase its extent, said apparatus further including a primary track support member and primary track means integral therewith positioned above said jig assembly, an auxiliary track support member and an auxiliary track means integral therewith which is hingedly mounted to said primary track support member, said first plurality of jig members being laterally movable along the extent of said jig assembly , said jig assembly including a fixed position forward side rail member and a rearward side rail member disposed parallel to said forward side rail member, said rearward side rail member being movably mounted for forward and rearward travel in a horizontal plane, and said jig assembly including a laterally member mounted for forward and rearward movement in a horizontal plane.

* * * * *